United States Patent [19]

Kobayashi

[11] Patent Number: 4,987,847

[45] Date of Patent: Jan. 29, 1991

[54] ANCHOR RETRIEVING DEVICE

[76] Inventor: Satoru Kobayashi, 33-8, Taishido 5-chome, Setagaya-ku, Tokyo 154, Japan

[21] Appl. No.: 525,766

[22] Filed: May 18, 1990

[30] Foreign Application Priority Data

May 19, 1989 [JP] Japan ..... 1-124539

[51] Int. Cl.[5] ..... B63B 21/24

[52] U.S. Cl. ..... 114/297; 114/299; 114/294

[58] Field of Search ..... 114/293, 294, 297–299, 114/304, 301, 310, 217; 294/66.1, 82.33; 43/12, 17, 17.2, 43.2, 43.4, 44.95

[56] References Cited

U.S. PATENT DOCUMENTS

| | | | |
|---|---|---|---|
| 2,857,875 | 10/1958 | Patton | 114/299 |
| 3,995,577 | 12/1976 | Gentry | 114/297 |
| 4,721,054 | 1/1988 | Kobayashi | 114/299 |
| 4,836,126 | 6/1989 | Kobayashi | 114/297 |

FOREIGN PATENT DOCUMENTS

| | | | |
|---|---|---|---|
| 0275085 | 12/1986 | Japan | 114/297 |

*Primary Examiner*—Joseph F. Peters, Jr.
*Assistant Examiner*—Edwin L. Swinehart
*Attorney, Agent, or Firm*—Laff, Whitesel, Conte & Saret

[57] ABSTRACT

An anchor retrieving device for transmitting the anchoring power from a main anchoring line to the end of a shank of an anchor opposite to the crown end when the device is held in the locking position and for transmitting the anchor raising power from the main anchoring line to the crown end when the device is held in the unlocking position. The anchor retrieving device comprises a first lock assembly having a hook member, a weight for striking said first lock assembly when it is desired to bring the first lock assembly in the unlocked position, a second lock assembly connected to the end of the shank opposite to the crown end to be moved between locking and unlocking positions, a connection line for connecting the hook member to the second lock assembly to transmit the anchoring power and having guides. an unlocking line for moving the second lock assembly to the unlocking position and being guided along the connection line through the guides, and an anchor retrieving line for connecting the second lock assembly to the crown end of the shank.

4 Claims, 3 Drawing Sheets

ANCHOR RETRIEVING DEVICE

BACKGROUND OF THE INVENTION

1. Field of the Invention

The present invention relates generally to an improvement in or relating to anchors, and particularly to an improved anchor retrieving device adapted to be interposed between an anchor and one end of a main anchoring line to retrieve the anchor when it becomes snagged at the bottom of a body of water, for example, seized by roots or ledges of rocks or submerged timbers or like.

2. Related Art Statement

It might often arise a case where an anchor becomes snagged by roots, rocks or like to make it impossible to raise the anchor to the boat or ship. In order to release the anchor and to bring the same in condition for easy raising, I have previously proposed an anchor arrangement. The anchor arrangement according to my previous proposal, comprises a flexible rope having a free end, retaining device for detachably retaining the free end of the rope and being attached to the rope and normally held at a position separated from the free end of the rope by a certain distance, an anchor attached to the rope and having a shank and at least one grasping means (fluke in one embodiment) extending backwardly from one end of the shank for grasping a rock at the bottom of a body of water. The shank of the anchor is attached to the rope so that the one end formed with the fluke is positioned remoter from the free end of the rope. The arrangement further comprises means for opening the retaining device so that the free end of the rope is released therefrom in readiness for the anchor raising operation, upon impingement or striking by a weight.

The anchor arrangement of my prior proposal is disclosed in Japanese Patent Application No. 115232/1985 (corresponding to Japanese Patent Laid-Open Publication No. 275085/1986, U.S. Pat. No. 4,721,054 and European Patent No. 0206530B1). This is also disclosed in my co-pending Japanese Patent Appln. No. 173924/1986 (Japanese Patent Laid-Open Publication No. 31892/1988). The specification of the aforementioned U.S. Pat. No. 4,721,954 will be incorporated herein as a reference.

A similar anchor retrieving device is disclosed in U.S. Pat. No. 4,836,126 and European Patent Publication No. 0297703A which were filed while claiming a convention Priority based on Japanese Patent Appln. No. 151368/1987 (Japanese Patent Laid-Open Publication No. 315395/1988) and matured to patents.

The anchor retrieving device disclosed in U.S. Pat. No. 4,836,126 comprises a lock assembly having a releaseable hook member having one end normally locked by the lock assembly and the other end normally housed in the lock assembly at a position adjacent to the lower end of the lock assembly, the other end being connected through a connection line to the end of the shank opposite to the crown end. The crown end of the shank is connected through an anchor-retrieving line to the housing of the lock assembly. In the normal anchoring position, the anchoring power is transmitted from the end of the shank opposite to the crown end through the connection line and the releaseable hook member to the main anchoring line; and when it is desired to retrieve the anchor from the snagged condition, the lock assembly is struck by a weight to release the releaseable hook member from the lock assembly to disconnect the connection line so that the anchor is raised by the anchor-retrieving line connected between the lower end of the lock assembly and the crown end of the shank. The specification of the aforementioned U.S. Pat. No. 4,836,126 will be incorporated herein as a reference.

However, in these known anchor retrieving devices, the connection line connecting the lock assembly and the end of the shank opposite to the crown end is so long as to intertwine with the anchor-retrieving line as the anchor is rotated during the anchor lowering operation to make it hard to retrieve the anchor by pulling it through the anchor-retrieving line.

OBJECTS AND SUMMARY OF THE INVENTION

The object of this invention is to provide an improved anchor retrieving device enabling reliable anchor retrieving operation.

A more specific object of this invention is to provide an improved anchor retrieving device having an anchor-retrieving line which is prevented from intertwining with the connection line to ensure smooth retrieval of the anchor.

With the aforementioned objects in view, the present invention provides an anchor retrieving device adapted to be interposed between an anchor and one end of a main anchoring line, said anchor including a shank having a crown end and at least one fluke, said anchor retrieving device transmitting the anchoring power from said main anchoring line to the end of said shank opposite to said crown end when it is held in the locking position and transmitting the anchor raising power from said main anchoring line to said crown end when it is held in the unlocking position, said anchor retrieving device comprising:

a first lock assembly having an upper end connected to said one end of said main anchoring line and having a hook member releaseably locked when said anchor retrieving device is in the locking position;

a weight slidably engaging said main anchoring line and adapted to be dropped downwardly along said main anchoring line to strike said first lock assembly;

a second lock assembly releaseably connected to said end of said shank opposite to said crown end and having releasing means for releasing said second lock assembly from said end of said shank opposite to said crown end when said anchor retrieving device is in the unlocking position;

a connection line for connecting said hook member to said second lock assembly for transmitting the anchoring power from said main anchoring line through said first lock assembly and said second lock assembly to said end of said shank opposite to said crown end when said anchor retrieving device is in the locking position, said connection line having guide means disposed along said connection line;

an unlocking line for connecting the lower end of said first lock assembly to said releasing means of said second lock assembly while being guided through said guide means of said connection line; and an anchor-retrieving line for connecting said second lock assembly to said crown end of said shank;

whereby the anchoring power is transmitted through said main anchoring line, said first lock assembly, said hook member, said connection line and said second lock assembly to said end of said shank opposite to said crown end of said shank when said anchor retrieving device is in the locking position, and said anchor retrieving device is turned to the the unlocking position as said weight strikes said first lock assembly to release said hook member from said first lock assembly while said second lock assembly is unlocked by the power transmitted through said unlocking line so that the anchor raising power is transmitted through said main anchoring line, said first lock assembly, said connection line, said second lock assembly and said anchor-retrieving line to said crown end of said shank.

In a preferred embodiment, said connection line is a chain composed of plural rings connected with one another, said guide means comprising annular guide pins each protruding from the periphery of each ring so that said guide pins align along the longitudinal direction of said chain, and said unlocking line is a flexible wire inserted through said guide pins.

DESCRIPTION OF THE APPENDED DRAWINGS

The above and other objects and advantages of this invention will be easily understood by those skilled in the art by reading the following detailed description of a presently preferred embodiment thereof while referring to the appended drawings, in which.

DESCRIPTION OF THE PREFERRED EMBODIMENT

The present invention will now be described in detail by referring to a presently preferred embodiment thereof.

Initiallly referring to FIGS. 2A and 2B, the first lock assembly will be described.

Figure 1:
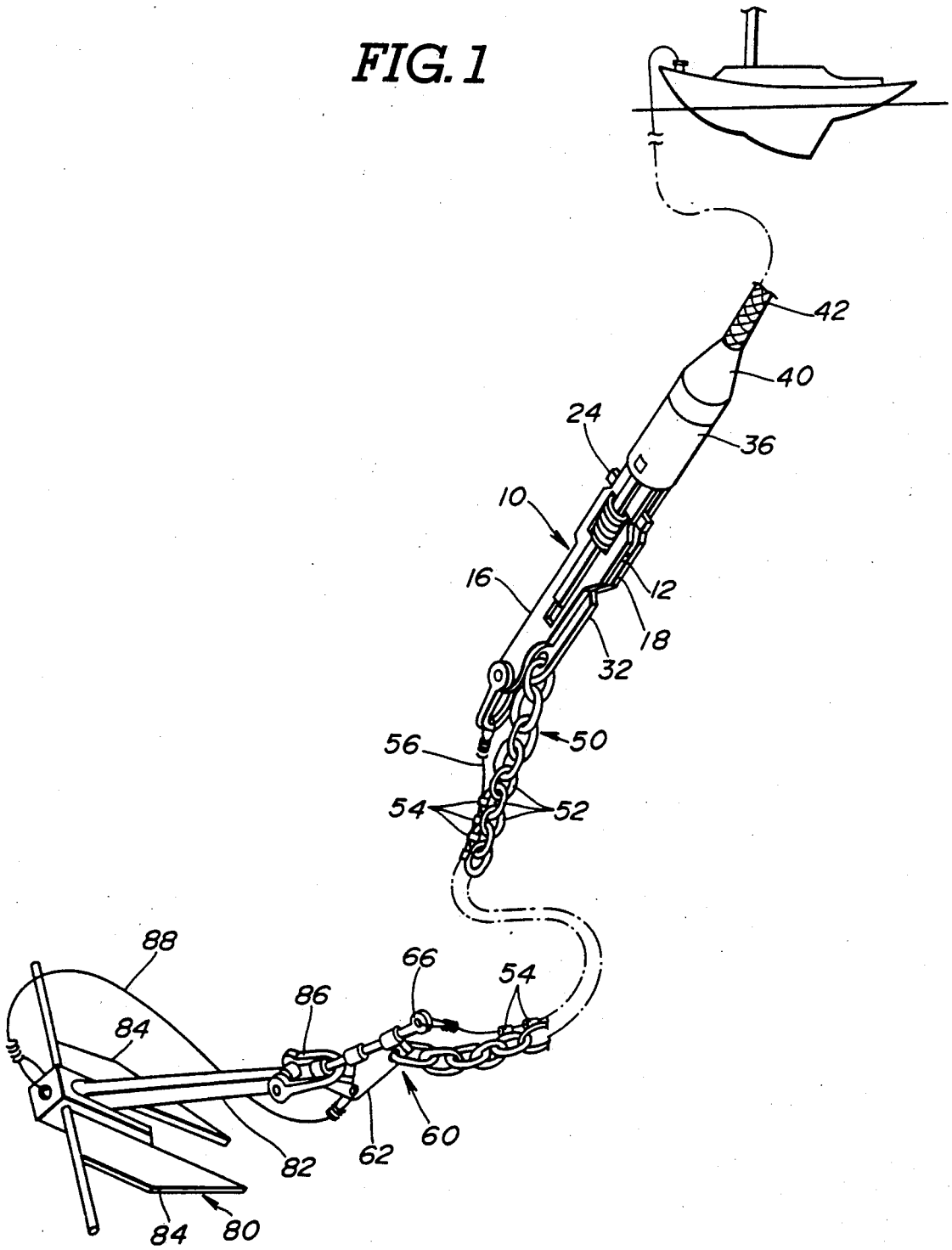
FIG. 1 is a diagrammatical illustration showing an embodiment of this invention combined with an anchor and held in the normal anchoring condition.
Figure 2A:
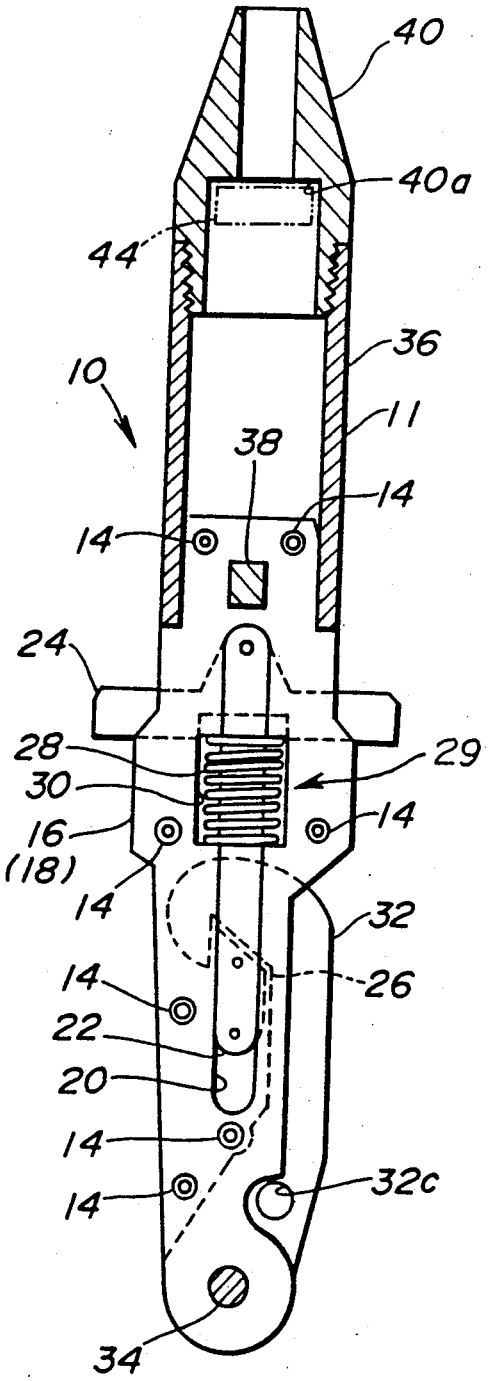
FIG. 2A is a side elevational view, partly in section, of the first lock assembly as it is in the locking position.
Figure 2B:
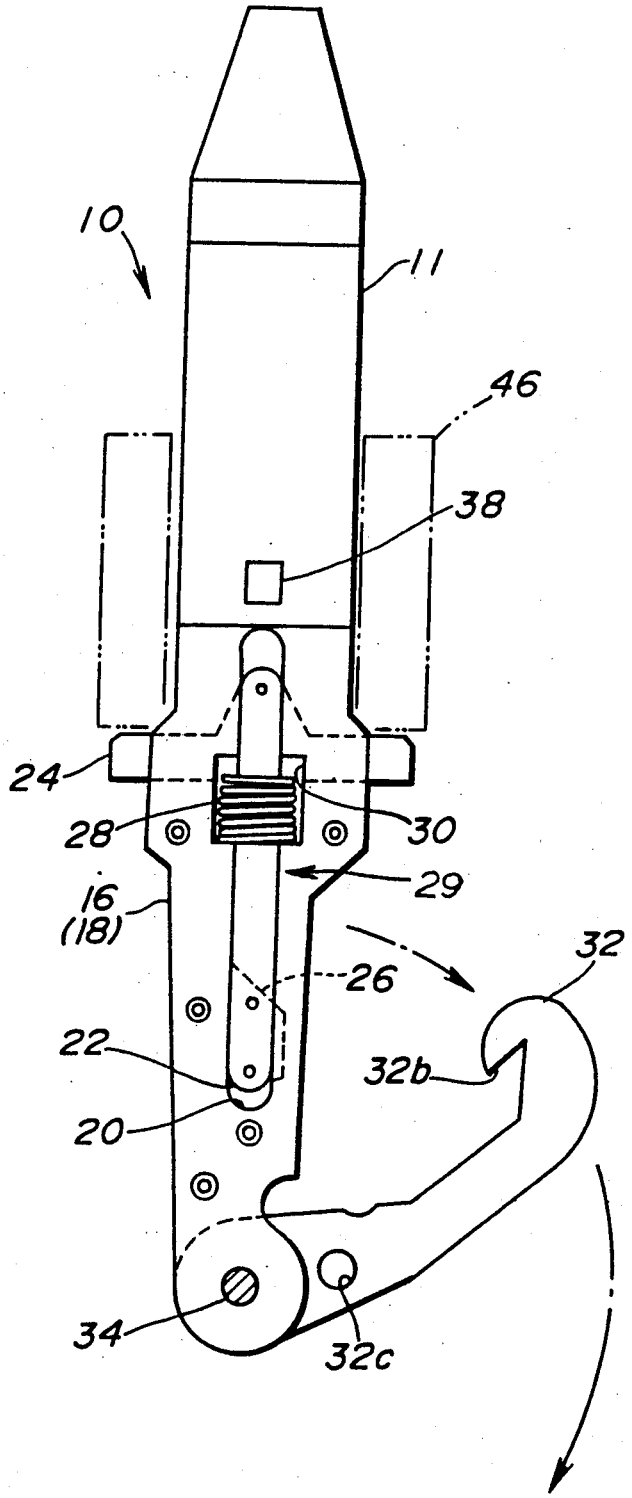
FIG. 2B is a side elevational view of the first lock assembly, with the hook member being in the unlocked position.

In FIGS. 2A and 2B, the first lock assembly is generally denoted by 10. The first lock assembly 10 has a housing 11 which is defined by a core plate 12 (see FIG. 1), paired side wall plates 16, 18 securedly fitted to cover the sides of the core plate 12 by means of rivets 14, each of the side plates 16, 18 having a longitudinal slot 20 extending along the longitudinal direction of the housing 11. A pair of guide rods 22, 22 are housed in the longitudinal slots 20,20 of the side wall plates 16, 18 to be moved along the longitudinal direction. An upper crossing member 24 is pivotally carried at an upper portion of the guide rods 22, 22, and a lock pawl 26 is carried by the lower end of the guide rods 22, 22. A coil spring 28, as a biasing means, surrounds the guide rods 22, 22 and has a lower end circumference seated on the bottom ledges of enlarged portions or windows 30, 30 of the longitudinal slots 20, 20. The top end circumference of the coil spring 28 abuts against the bottom of the upper crossing member 24 to urge the member 24 maintained at its upper position under normal condition when no striking force is applied on the member 24. Both ends of the upper crossing member 24 protrude beyond the side wall plates 16, 18 to be struck by a weight 46 as will be described hereinafter.

The guide rods 22, the upper crossing member 24 and the lock pawl 26 are thus connected together and movably housed in the housing 11 of the lock assembly 10 while being applied with a biasing force by the coil spring 28 to form a movable locking block 29.

A hook member 32 is contained in the housing 11 and has a thickness slightly thinner than the wall thickness of the core plate 12 to be loosely set in the gap or space between the side wall plates 16 and 18. The hook member 32 has a generally crescent shape in the illustrated embodiment. The lower end of the hook member 32 is swingably carried by a pin 34 at the lower ends of the side wall plates 16, 18. The upper end of the hook member 32 is shaped to form a hooked latch end **32*b* which is engaged with the lock pawl 26**.

As the upper portion of the hook member 32 is pushed in-between both the side wall plates 16 and 18, the hooked latch end **32*b* once pushes the lock pawl 26 downwards and then the lock pawl 26 is returned back upwards by the action of the coil spring 28 so that the hook member 32 is engaged by the lock pawl 26. As a result, the hook member 32 is securely and firmly locked to the first lock assembly 10**.

A cylinder 36 is secured on the upper portions of the side wall plates 16, 18, and firmly connected by a crossing pin 38. A frust-conical cap 40 is screw-fitted over the top portion of the cylinder 36. A main anchoring line 42 is inserted through the center hole of the cap 40, and the lower end of the line 42 is bound to a binding pin 44 so that the main anchoring line 42 is connected to the first lock assembly 10. The binding pin 44 engages with the stepped portion **40*a* formed within the cap 40 to prevent the main anchoring line 42** from being stripped off.

Referring now to FIG. 2B, a weight 46 is denoted by the dots-and-dash line, and composed of two half-cylinders connected with each other by hinges (not shown) to be opened or closed by means of a lock (not shown). When it is desired to release the first lock assembly 10, the weight 46 is dropped along the main anchoring line 42 to strike the protruding ends of the upper crossing member 24 as shown in FIG. 2B, so that the upper crossing member 24 is moved downwards together with the lock pawl 26 to disengage the hook member 32 from the lock pawl 26.

Figure 3:
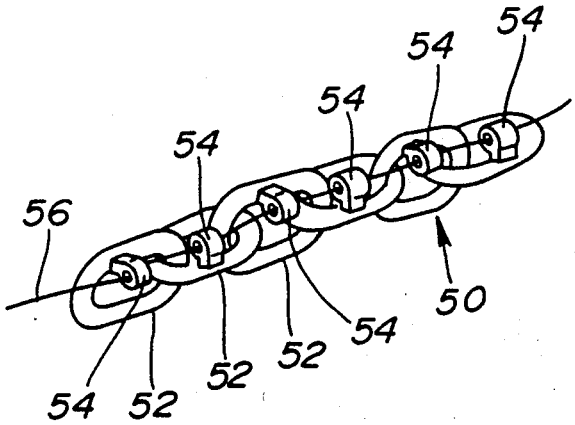
FIG. 3 is a perspective view showing a portion of the connection line.

Referring to FIGS. 1 and 3, reference numeral 50 designates a chain serving as the connection line. The chain 50 is composed of plural rings 50 connected with one another. Each ring 52 is provided with an annular guide pin 54. Annular guide pins 54 of respective rings 52 are aligned so that a substantially linear guide line (guide means) is formed by them. A wire 56 serving as an unlocking line is inserted through these guide pins 54.

One end (upper end) of the chain 50 is connected to the lower portion of the hook member 32 of the first lock assembly 10. One end (upper end) of the unlocking line 56 is connected to the pin 34 of the first lock assembly 10.

Figure 4:
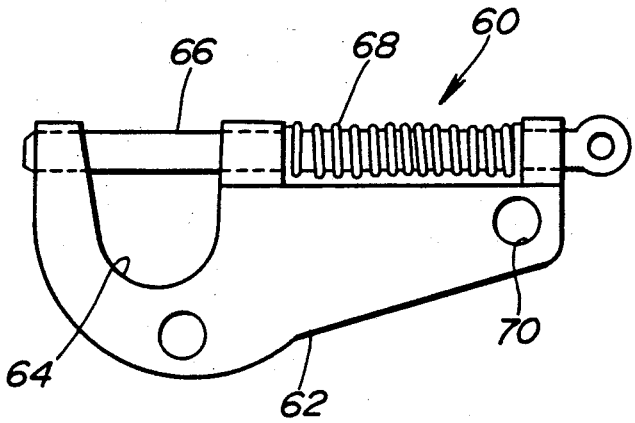
FIG. 4 is a side elevational view of the second lock assembly.

Reference numeral 60 designates a second lock assembly. As shown in FIG. 4, the second lock assembly 60 comprises a body block 62 formed with a cut-out 64 having a general section of letter U, a rod 66 retractably extending across the cut-out 64 and normally biased to close the opening of the cut-out 64 by means of a compression spring 68. An engage hole 70 is formed at the end opposite to the cut-out 64 for receiving the lower end of the chain 50. One end (the right-hand end as viewed in FIG. 4) of the rod 66 is connected with the unlocking line 56. As will be seen from FIG. 4, the inner face of the cut-out 64 is diverged outwardly to enable smooth retrieval of a shackle 86 of an anchor 80 when the rod 66 is retracted to open the cut-out 64, as will be described in detail hereinafter. The rod 66 serves as the releasing means for retrieving the second lock assembly 60 from the end of the shank 82 opposite to the crown end.

Referring back to FIG. 1, a Danforth type anchor 80 has a shank 82, and flukes 84 are attached to the crown end of the shank 82 to be swingable within a certain angular range. The end of the shank 82 opposite to the crown end is connected to the cut-out 64 of the second lock assembly 60. In detail, the rod 66 which serves as the releasing means is pulled against the biasing force of the compression spring 68 to open the opening of the cut-out 64 and the shackle 86 attached to the end of the shank 82 opposite to the crown end is received in the cut-out 64, and then the rod is extended across the cut-out 64. The end of the flukes 84 attached to the crown end of the shank 82 is connected through an anchor-retrieving line 88 made of, for example a wire, to the lower end of the body block 62 of the second lock assembly 60.

As the hook member 32 is engaged with the lock pawl 26 of the first lock assembly 10, as shown in FIG. 1, the tension through the main anchoring line 42 is transmitted through the chain 50 to the body block 62 of the second lock assembly 60. The length of the anchor-retrieving line 88 is longer than the length of the shank 82.

Accordingly, as the hook member 32 is locked by the first lock assembly 10 as shown in FIG. 1, the anchoring force from the anchor 80 is transmitted through the second lock assembly 60, the chanin 50, the first lock assembly 10 and the main anchoring line 42 to the boat, so that the boat is anchored.

In an event when the anchor 80 is caught by roots of seaweed, rocks or other massive obstacles and the anchor 80 cannot be raised by a simple operation, the hook member 32 is released from the lock pawl 26 by striking the upper crossing member 24 by the weight 46 as shown in FIG. 2B. In detail, the weight 46 is mounted around the main anchoring line 42 so that the line 42 is loosely surrounded by the inner periphery of the cylindrical weight 46, and then the weight 46 is dropped along the main anchoring line 42. The weight 46 strikes the protruding ends of the upper crossing member 24 of the first lock assembly 10, as shown in FIG. 2B, so that the upper crossing member 24, guide rods 22, 22 and the lock pawl 26 are moved downwards against the biasing force of the coil spring 28. Whereupon, the lock pawl 26 is disengaged from the latch end **32*b* of the hook member 32, and then the hook member 32 is swung about the pin 34 in the clockwise direction as viewed in FIG. 2B. As best seen from FIG. 2A, the hole 32*c* to which one end of the chain 50 is connected is somewhat deviated outwards (toward the right-hand direction in FIG. 2A) from the linear line extending from the center axis of the main anchoring line 42 to the center point of the pin 34. This deviation ensures that the hook member 32 is swung about the pin 34 by the tension transmitted from the chain 50** in the clockwise direction to be in the unlocked condition.

As the hook member 32 is disengaged from the lock pawl 26, the tension from the main anchoring line 42 is transmitted through the unlocking line 56 to the rod 66 of the second lock assembly 60, so that the rod 66 is pulled against the biasing force of the compression spring 68. As a result, the cut-out 64 is opened so that the shackle 86 comes out of the cut-out 64. Thus, the anchor 80 is connected through the anchor-retrieving line 88 to the second lock assembly 60, so that anchor raising force is transmitted through the anchor-retrieving line 88 to the crown end of the shank 82. Accordingly, by hoisting or otherwise hauling the main anchoring line 42, the anchor 80 is raised with its crown end held upside to result in easy retrieval of the flukes 84 from the snagged condition.

It is to be noted here that the hook member 32 is swingably mounted to the lower end of the first lock assembly 10, but not separated from the first lock assembly 10 in the unlocking condition.

As will be understood from the foregoing, according to the present invention, the main anchoring line is connected through the first lock assembly, the connection line and the second lock assembly to the anchor, and when the first lock assembly is unlocked by striking the same by a dropping weight, the second lock assembly is in turn unlocked by the unlocking line which extends along the connection line while guided by the guide means disposed along the connection line. Accordingly, the unlocking line is prevented from intertwining with the connection line. Since the second lock assembly is positioned close to the anchor, there is no fear that the anchor-retrieving line for unlocking the second lock assembly is intertwining with other lines. Accordingly, smooth and reliable unlocking operation is ensured when it is desired to raise the anchor with the crown end held upside.

What is claimed is:

1. An anchor retrieving device adapted to be interposed between an anchor and one end of a main anchoring line, said anchor including a shank having a crown end and at least one fluke, said anchor retrieving device transmitting the anchoring power from said main anchoring line to the end of said shank opposite to said crown end when it is held in the locking position and transmitting the anchor raising power from said main anchoring line to said crown end when it is held in the unlocking position, said anchor retrieving device comprising:

a first lock assembly having an upper end connected to said one end of said main anchoring line and having a hook member releaseably locked when said anchor retrieving device is in the locking position;

a weight slidably engaging said main anchoring line and adapted to be dropped downwardly along said main anchoring line to strike said first lock assembly;

a second lock assembly releaseably connected to said end of said shank opposite to said crown end and having releasing means for releasing said second lock assembly from said end of said shank opposite to said crown end when said anchor retrieving device is in the unlocking position;

a connection line for connecting said hook member to said second lock assembly for transmitting the anchoring power from said main anchoring line through said first lock assembly and said second lock assembly to said end of said shank opposite to said crown end when said anchor retrieving device is in the locking position, said connection line having guide means disposed along said connection line;

an unlocking line for connecting the lower end of said first lock assembly to said releasing means of said second lock assembly while being guided through said guide means of said connection line; and an anchor-retrieving line for connecting said second lock assembly to said crown end of said shank;

whereby the anchoring power is transmitted through said main anchoring line, said first lock assembly, said hook member, said connection line and said second lock assembly to said end of said shank opposite to said crown end of said shank when said anchor retrieving device is in the locking position, and said anchor retrieving device is turned to the unlocking position as said weight strikes said first lock assembly to release said hook member from said first lock assembly while said second lock assembly is unlocked by the power transmitted through said unlocking line so that the anchor raising power is transmitted through said main anchoring line, said first lock assembly, said connection line, said second lock assembly and said anchor-retrieving line to said crown end of said shank.

2. The anchor retrieving device according to claim 1, wherein said first lock assembly comprises a housing for accommodating said hook member during the normal anchoring operation, a movable locking block housed in said housing for movement between a locking position and an unlocking position along an axial direction of said housing, and biasing means normally biasing said movable locking block into its locking position and releasing said hook member when struck by said weight to swing said hook member to the unlocked position.

3. The anchor retrieving device according to claim 2, wherein said hook member has a lower end swingably carried by the lower end of said housing and an upper end releaseably locked by said movable locking block.

4. The anchor retrieving device according to claim 1, wherein said connection line is a chain composed of plural rings connected with one another, and said guide means comprise annular guide pins each protruding from the periphery of each ring so that said guide pins align along the longitudinal direction of said chain, and wherein said unlocking line is a flexible wire inserted through said guide pins.

* * * * *